United States Patent [19]

Dilg et al.

[11] 4,135,629

[45] Jan. 23, 1979

[54] COUPLER KNUCKLE WITH SAFETY SHELF

[75] Inventors: Walter C. Dilg, Elma; Albert E. Martin, Lancaster, both of N.Y.

[73] Assignee: Dresser Industries, Inc., Dallas, Tex.

[21] Appl. No.: 792,160

[22] Filed: Apr. 29, 1977

[51] Int. Cl.[2] ..... B61G 3/00

[52] U.S. Cl. ..... 213/153

[58] Field of Search ..... 213/100 R, 110, 153

[56] References Cited

U.S. PATENT DOCUMENTS

| | | | |
|---|---|---|---|
| 631,067 | 8/1899 | Ellingson | 213/153 |
| 835,560 | 11/1906 | Schatzka | 213/153 |
| 2,214,718 | 9/1940 | Christianson | 213/153 |

*Primary Examiner*—Trygve M. Blix
*Assistant Examiner*—Jesus D. Sotelo
*Attorney, Agent, or Firm*—Raymond T. Majesko; John N. Hazelwood

[57] ABSTRACT

To prevent vertical disengagement of the knuckles of railway car couplers, for example type "E" couplers, a vertical upward extension is provided on the forward nose of the knuckle which terminates in a shelf extending over the buffing face of the nose. The pulling face of the extension tapers upwardly toward the buffing face to allow for vertical angling thereof.

6 Claims, 3 Drawing Figures

COUPLER KNUCKLE WITH SAFETY SHELF

BACKGROUND OF THE INVENTION

Railroad experience has shown that preventing the uncoupling of railroad cars when trains are accidentally derailed, reduces the seriousness of the aftermath of such an incident. In particular, keeping the car in a train coupled together, controls three typical behavior patterns for derailed cars involved in an accident.

These behavior patterns include end puncture, pile up and rollover spills. By keeping the couplers engaged in the event of a derailment, it is less likely that the coupler from one car will ride up over the coupler of an adjacent car and puncture the end of the car upon coupler impact.

This hazard is especially serious in connection with tank cars where the puncture of the end of it by an adjacent coupler can release large amounts of hazardous material, thereby, creating a danger to life and property. When cars remain coupled together during derailment, it is less likely that they will pile up or domino. When pile ups do occur, the hazard of subsequent explosions and fires is greatly increased because fire or explosion in one car impinges on adjacent tanks and the effects are compounded.

When the cars remained coupled after a derailment, car rollovers tend to be prevented for the reason that the fastened coupler on an upright car tends to keep the adjacent car from tipping over. Here again the hazard is reduced which might otherwise be generated by material being spilled out of the manway of the car. Also, this minimizes the chance of damaging or shearing top fittings as a result of the car turning upside down.

Railway cars become separated or uncoupled in a train derailment because of vertical displacement between cars which permits the knuckles of mating couplers to disengage by sliding apart in a vertical direction. This is an unrestrained disengagement when the conventional type "E" coupler is employed. Most freight cars in the United States are so equipped. Various attempts have been made to maintain cars coupled in the event of a derailment. One form of car coupler presently being used is the type "F" coupler. The type "F" coupler is a special design to prevent vertical disengagement and is substantially more complicated than the type "E" coupler, since it is necessary to incorporate in it extra mechanical parts to provide for vertical and lateral displacement flexibility.

The type "F" coupler has many disadvantages. First, to perform the interlocking function in both upward and donward directions, mating type "F" couplers on the adjacent coupled cars are needed. When a type "F" coupler engages a type "E" coupler, the type "E" may move freely upward to the point of disengagement. As presently designed, the type "F" coupler cannot be installed readily on railroad cars presently in service. Thus, even if the type "F" coupler is installed on all new railroad cars, this will have only partial effect in improving the safety record of the many thousands of cars provided with the type "E" coupler, which currently are in service.

Secondly, the type "F" is significantly more expensive than the type "E" coupler to install initially on railroad cars. Since the type "F" coupler is more complicated, its maintenance cost is relatively high and its mechanical reliability is less favorable than for the simple type "E" coupler.

Numerous modifications were proposed for the type "E" coupler; however, none to date, have been commercially accepted.

Accordingly, it is an object of the present invention to provide a type "E" coupler having a means to prevent vertical disengagement of the knuckles.

Another object of the invention is to provide a coupler of the above type which, in addition, permits vertical angling.

DETAILED DESCRIPTION OF THE PREFERRED EMBODIMENT

In accordance with the present invention, there is provided a railway car coupler knuckle having a forward nose and a rearward tail. The forward nose has an outer buffing face and in inner pulling face. The improvement is that the forward nose has a vertical upward extension terminating in a shelf which laterally extends over the buffing face of the nose. The pulling face of the extension is inclined forwardly toward the buffing face to permit vertical angling of the coupler.

Preferably, the buffing face of the extension is substantially in alignment or coplaner with the buffing face of the nose. Also, it is preferred that the extension be inclined no more than about 5°.

Figure 1:
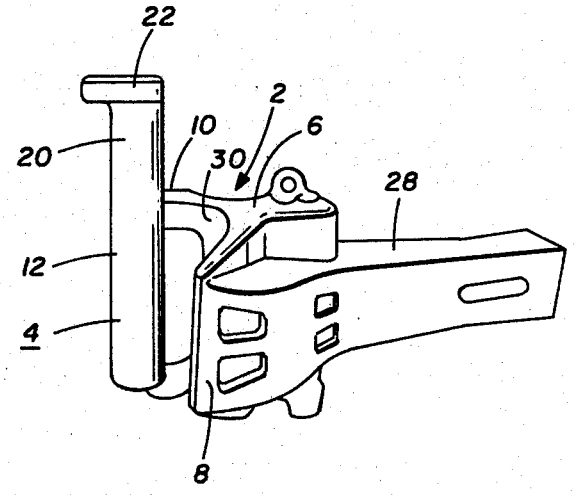
FIG. 1 is a perspective view of the coupler of the invention.
Figure 2:
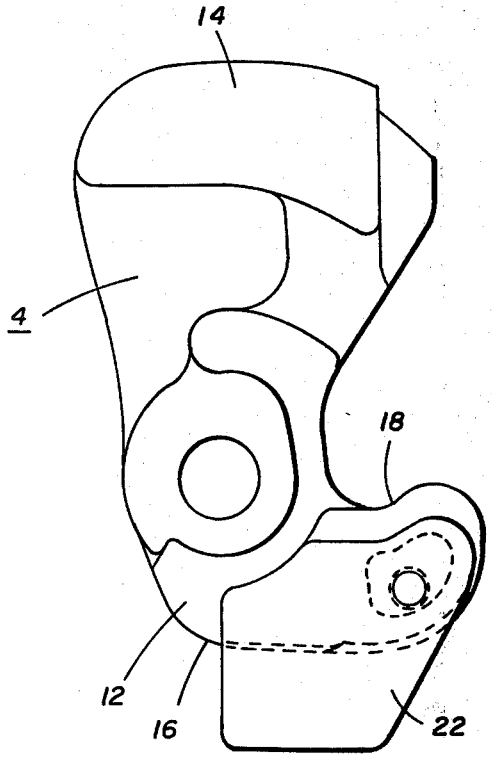
FIG. 2 is a top plan view of the knuckle of the coupler of FIG. 1.
Figure 3:
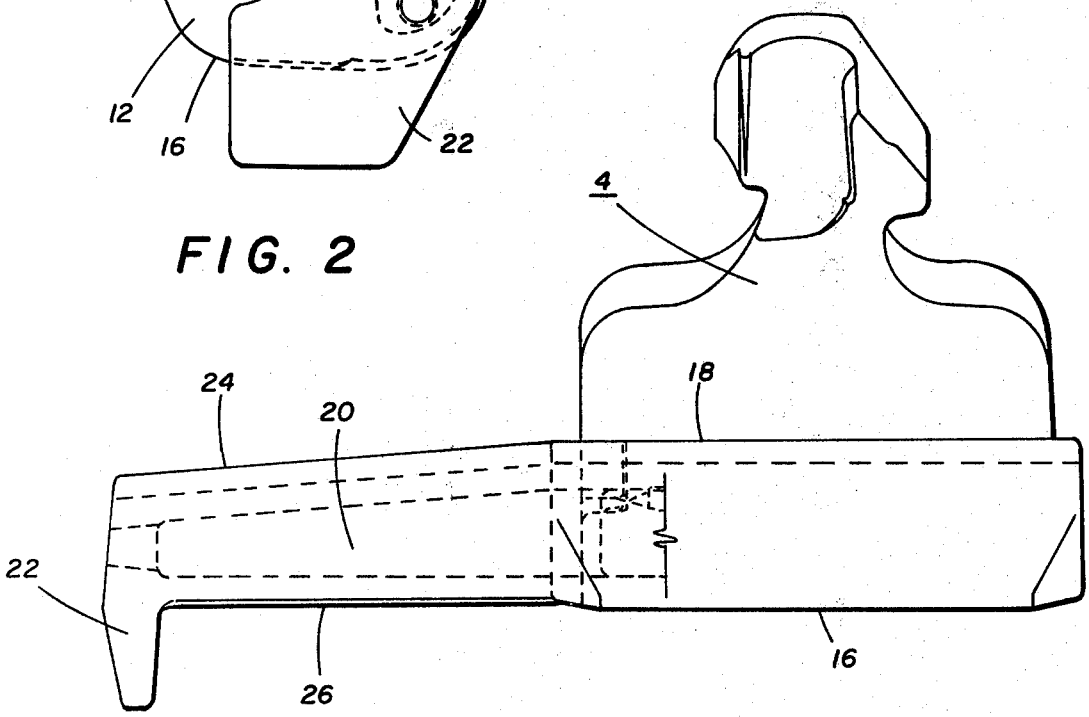
FIG. 3 is a side elevation view of the knuckle of the coupler of FIG. 1.

Referring to the drawing, FIG. 1 illustrates a typical American Association of Railroads (AAR) standard "E" coupler generally designated 2, modified in accordance with the invention. FIGS. 2 and 3 illustrate the knuckle 4 portion of that coupler. The knuckle is pivotally connected by a pin (not shown) to a coupler head 6 and is shown in FIG. 1 in partially opened position. The coupler head or housing 6 contains a guard arm side 8 and a knuckle side 10.

The knuckle 4 has a forward nose 12 and a rearward tail 14. The forward nose 12 has a vertical upward extension 20 terminating in a shelf 22 which extends over the buffing face 16 of the nose.

The pulling face 24 of the extension is inclined upwardly toward the buffing face to permit vertical angling. The buffing face 26 of the extension is substantially coplaner with the buffing face of the nose.

The coupler also contains a shank 28 which extends rearwardly from the head 6 and is suitably secured to a railway car.

The head casting 6 also contains a knuckle receiving recess 30 that is arranged to receive a knuckle of a mating coupler. The knuckle 4 would be held in interlocking relation or coupler relation to a similar coupler by the conventional locking mechanism of a type "E" coupler which can be manually or otherwise released when required.

The knuckle extension as shown is inclined at an angle of approximately 4°10′ from the vertical, making the extension narrower at the top end by approximately 21/32″.

The extension preferably is cast integrally with the knuckle on new couplers. However, the extension could be welded to existing type "E" couplers now in use.

Thus, with the present construction, when the couplers are coupled, the shelves will overlap the top of the couplers and while allowing limited vertical movement of either shelf relative to the other, will prevent such movement beyond the limit allowed.

It is intended that the foregoing description and drawings be construed as illustrative and not in limitation of the invention.

The embodiments of the invention in which an exclusive property or privilege is claimed are defined as follows:

1. In a coupler for a railway car having a coupler housing with a guard arm side and a knuckle side, a knuckle mounted on the knuckle side by a pivot pin disposed in a pivot pin hole and having a forward nose and a rearward tail, said forward nose having an outer buffing face and an inner pulling face, the improvement comprising said forward nose having a vertical upward extension terminating in a shelf which laterally extends over the buffing face of the nose, the pulling face of the extension being inclined forwardly toward the buffing face to permit vertical angling of the coupler.

2. A coupler according to claim 1 in which the buffing face of the extension is substantially in alignment with the buffing face of the nose.

3. A coupler according to claim 1 in which the extension is inclined no more than about 5°.

4. A railway car coupler knuckle having a forward nose and a rearward tail, said forward nose having an outer buffing face and an inner pulling face, the improvement comprising said forward nose having a vertical upward extension terminating in a shelf which laterally extends over the buffing face of the nose, the pulling face of the extension being inclined forwardly toward the buffing face to permit vertical angling of the coupler.

5. A knuckle according to claim 4 in which the buffing face of the extension is substantially in alignment with the buffing face of the nose.

6. A knuckle according to claim 4 in which the extension is inclined no more than about 5°.

* * * * *